United States Patent [19]

Isono

[11] 4,006,121

[45] Feb. 1, 1977

[54] DOOR LATCH MECHANISM CONTROLLING SWITCH IN MICROWAVE OVEN OR THE LIKE

[75] Inventor: Tatsuji Isono, Kadoma, Japan

[73] Assignee: Matsushita Electric Industrial Co., Ltd., Japan

[22] Filed: June 24, 1974

[21] Appl. No.: 482,654

[30] Foreign Application Priority Data

June 27, 1973 Japan ..... 48-77025[U]
June 27, 1973 Japan ..... 48-77026[U]

[52] U.S. Cl. ..... 200/61.64; 200/50 A; 219/10.55 C

[51] Int. Cl.² ..... H01H 3/16; H01H 9/20; H05B 9/06

[58] Field of Search ..... 200/50 A, 61.62, 61.64–61.68, 200/61.76–61.8; 219/10.55 C; 126/197

[56] References Cited

UNITED STATES PATENTS

| | | | |
|---|---|---|---|
| 3,416,515 | 12/1968 | Mertler | 126/197 X |
| 3,659,068 | 4/1972 | Duffner et al. | 219/10.55 C |
| 3,691,329 | 9/1972 | Ball | 200/50 A |
| 3,715,552 | 2/1973 | Umezu et al. | 200/50 A X |
| 3,733,456 | 5/1973 | Blackburn | 219/10.55 C |
| 3,823,294 | 7/1974 | Takayama et al. | 219/10.55 C |
| 3,831,580 | 8/1974 | McLean | 126/197 |
| 3,865,097 | 2/1975 | Robinson | 126/197 |

*Primary Examiner*—James R. Scott
*Attorney, Agent, or Firm*—Robert E. Burns; Emmanuel J. Lobato; Bruce L. Adams

[57] ABSTRACT

A door latch mechanism which may be advantageously used for a door of electrical equipment such as a microwave oven, comprising a latch member on the door, catch means to engage the latch member when the door is closed, and resilient biasing means to bias the catch means into a position engaging the latch member. The catch means is moved into and out of the position to engage the latch member by means of a leverage linkage and the movement of the catch member into and out of the position to engage the latch member is transmitted to electric switch means through the leverage linkage. The door is opened only after the switch means has been made open.

14 Claims, 11 Drawing Figures

DOOR LATCH MECHANISM CONTROLLING SWITCH IN MICROWAVE OVEN OR THE LIKE

The present invention relates to latch mechanism to latch a door of electrical equipment such as a microwave oven.

One of the important requirements of the microwave oven is to prevent leakage of the microwaves when the door of the oven is open or being opened from the closed position. It is, for this reason, highly desirable to hold the door of the microwave oven securely latched when the door is closed and the oven is switched on and to unlatch the door only after the oven has been switched off. In order that the microwave oven be reliably switched off when the door is to be opened, it is also desirable that the opening movement of the door is sensitively responded to by the switch means of the microwave oven. An object of the present invention is to provide a door latch mechanism which is adapted to meet all these requirements of the microwave oven. While the latch mechanism embodying the present invention will be herein described as being installed on a microwave oven, it should be borne in mind that such is merely by way of example and, therefore, the latch mechanism according to the present invention will find various other practical applications especially in electrical equipment other than the microwave oven.

In accordance with the present invention, there is provided a door latch mechanism for latching a door structure to a casing comprising, in combination, a latch member movable with the door structure, a support member fixedly mounted on the casing, catch means supported on the support member and having a first position engageable with the latch member for latching the door structure to the casing and a second position unengageable with the latch member for maintaining the door structure unlatched from the casing, and resilient biasing means responsive to movement of the catch means between the first and second positions thereof and operative to bias the catch means toward the first position when the catch means is moved toward and into the first position and to bias the catch means toward the second position when the catch means is moved toward and into the second position. The latch mechanism may further comprise manually-operated unlatching means responsive to the movement of the catch means to the first position thereof and movable between a first position to allow the catch means to stay in the first position thereof and a second position to move the catch means out of the first position thereof, the unlatching means being thus held in the first position thereof when the catch means is in the first position thereof and being moved to the second position thereof when manually actuated. In this instance, the latch mechanism may still further comprise latching means responsive to the movement of the catch means to the first position thereof and to the movement of the unlatching means to the second position thereof and movable between a first position in latching engagement with the catch means when the catch means is moved to the first position thereof and a second position disengaged from the catch means when the unlatching means is moved to the second position thereof. In this instance, the latch mechanism may still further comprise a leverage linkage which is engageable at one end with the unlatching means and at the other end with the catch means and the latching means.

Where the latch mechanism is incorporated into electrical equipment having a door, such as the microwave oven as previously mentioned, the latch mechanism may comprise switch means having a closed condition responsive to the movement of the catch means to the first position thereof and an open condition responsive to the movement of the catch means to the second position thereof. In this instance, the latch mechanism may further comprise a leverage linkage which is engageable at one end with the catch means and at the other end with the switch means for thereby amplifying the amount of movement of the catch means to be transmitted to the switch means.

Where desired, the latch mechanism of the present invention may still further comprise stop means operative to forcibly hold the catch means in said second position thereof against the action of the resilient biasing means urging the catch means toward the second position thereof.

The catch means may comprise either a rotary catch member rotatably supported on the support member for being rotated between the first and second positions thereof or a reciprocating catch member which is axially movably supported on the support member for being axially moved between the first and second positions thereof. The rotary catch member may be formed with a catch portion engageable with the latch member when the catch means is in the first position thereof, and a lever portion merging from catch portion and engageable with the latch member when the latch member is in a position engageable with the catch portion and simultaneously the catch means is in the first position thereof so that the latch member is in pressing engagement with the lever portion when being moved to engage the catch portion and is forced away from the position engageable with the catch portion when the catch portion is disengaged from the latch member.

The features and advantages of the latch mechanism according to the present invention will become more apparent from the following description in which line reference numerals designated corresponding parts and structures throughout the figures and in which.

Figure 9A:
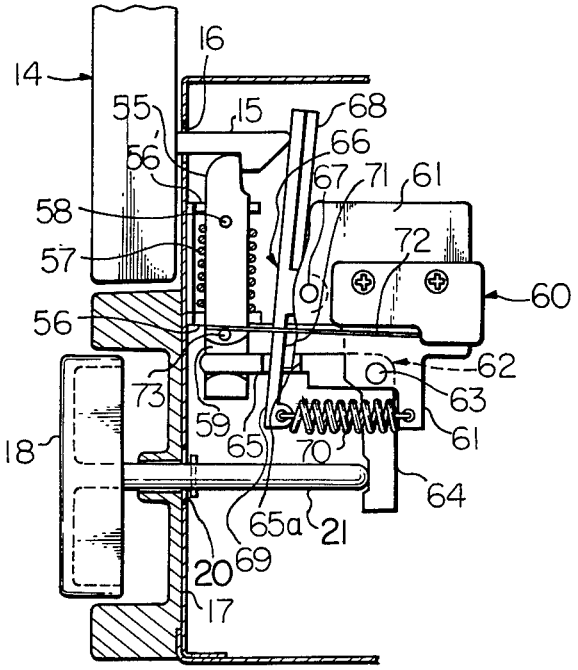
Figure 10:
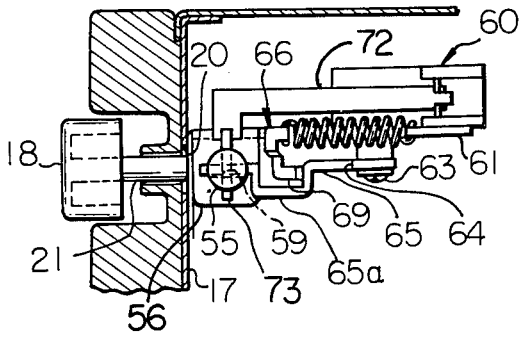
Figure 9B:
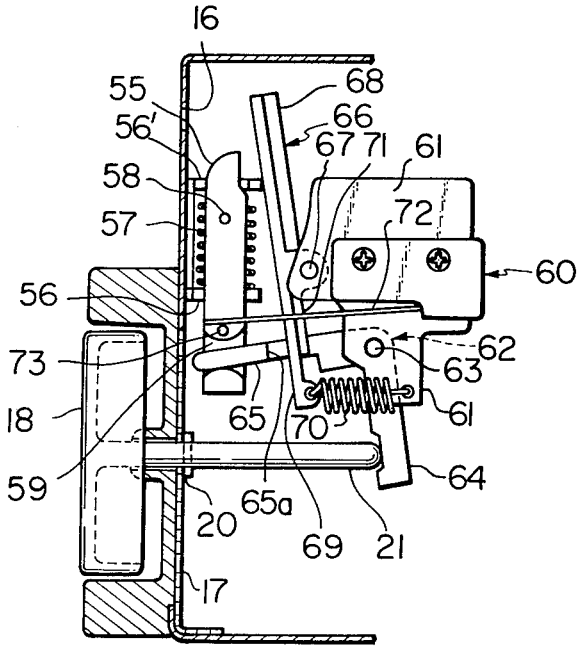

FIG. 9*a* is a top end view of a third preferred embodiment of the latch mechanism according to the present invention;

FIG. 9*b* is a similar view showing the latch mechanism in a different condition; and FIG. 10 is a side elevational view of the latch mechanism illustrated in FIG. 9*a*.

Figure 1:
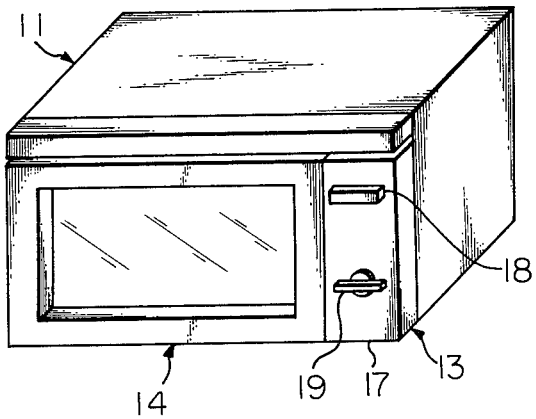
FIG. 1 is a perspective view of a microwave oven with the door in closed condition.
Figure 2:
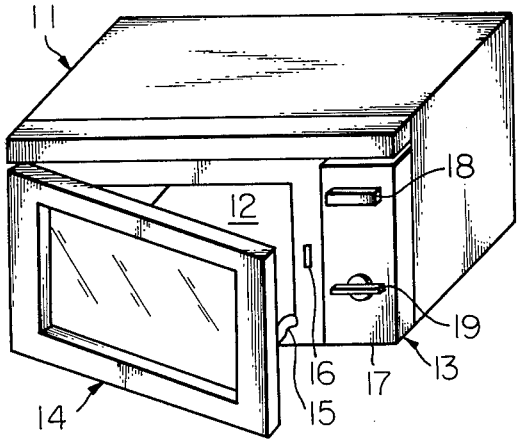
FIG. 2 is a view similar to FIG. 1 but shows the microwave oven with the door in open condition.

Referring to FIGS. 1 and 2, a microwave oven comprises a casing 11 having formed therein a cooking chamber 12 and a control section 13, and a door structure 14 which is hingedly connected at one vertical edge thereof to a vertical wall of the casing 11. The door structure 14 is thus rotatable about the hinged vertical edge between a position to close the cooking chamber 12 as shown in FIG. 1 and a position to open the cooking chamber 12 as shown in FIG. 2. When held in the position closing the cooking chamber 12, the door structure 14 is latching to the casing 11 by means of a latch mechanism to which the present invention is directed. The latch mechanism is shown in FIG. 2 as including a latch member 15 projecting substantially perpendicularly from an inner face of the door structure and located adjacent a free vertical edge of the door structure opposite to the hinged edge and an elongated slot 16 formed in the casing 11 and so located as to receive therein the latch member 15 when the door structure 14 is moved to the position closing the cooking chamber 12. A push-button 18 is mounted on a front end wall member 17 of the casing 11 defining the control section 13 so that the door structure 14 is unlatched from the casing 11 when the push-button 18 is manually depressed. Designated by reference numeral 19 is a control knob to vary the cooking time.

Figure 3:
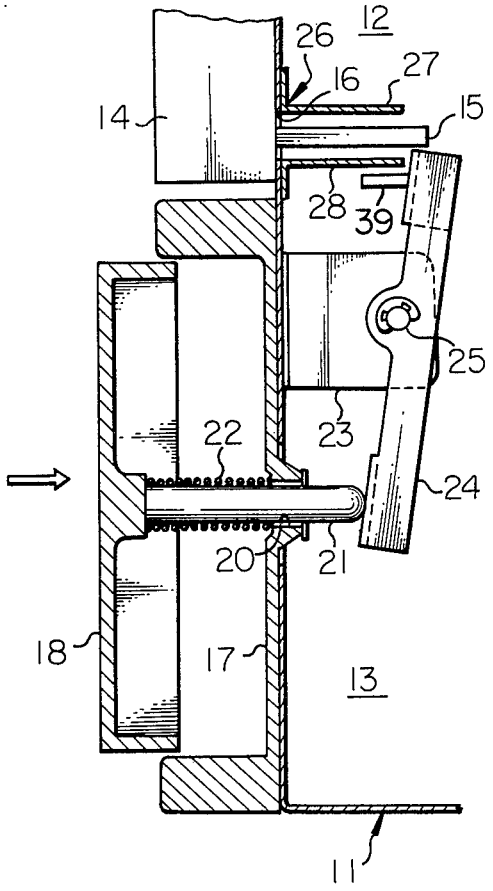
FIG. 3 is a top end view which shows, partly in horizontal section, manually-operated unlatching means forming part of a first preferred embodiment of the latch mechanism according to the present invention.
Figure 4:
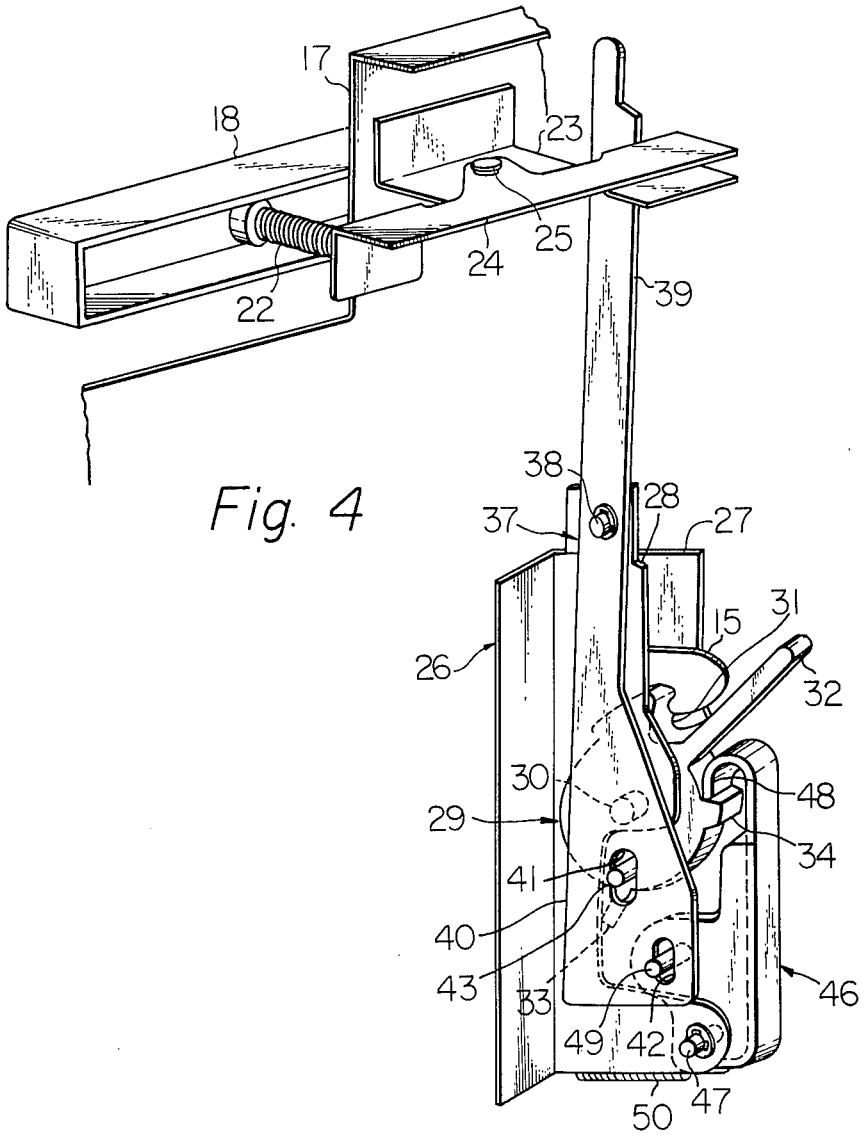
FIG. 4 is a perspective view of the overall construction of the first embodiment of the latch mechanism according to the present invention.
Figure 5:
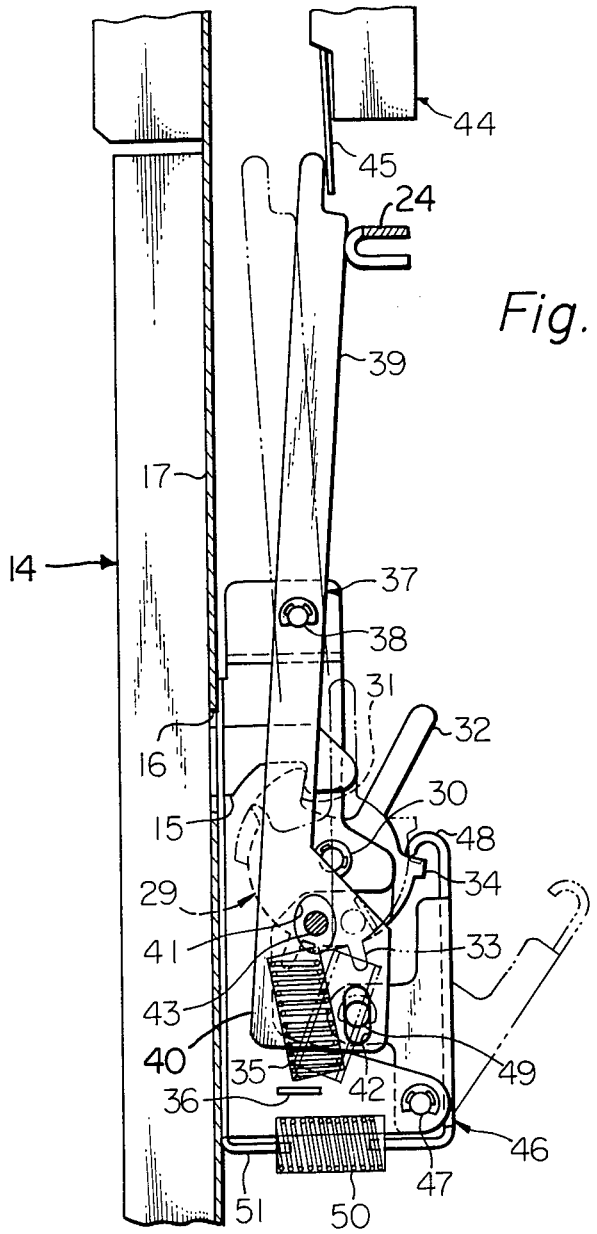
FIG. 5 is a side elevational view of the embodiment shown in FIG. 4.

Turning to FIGS. 3, 4 and 5, the front end wall 17 of the casing 11 defining the control section 13 is formed with an aperture 20 through which a pressing rod 21 is axially movable. The pressing rod 21 is connected at one end to the push-button 18 and projects at the other end into the interior of the control section 13. The pressing rod 21 is biased to urge the push-button 18 away from the front end wall 17 of the casing 11 by means of a preload spring 22 which is seated at one end on an inner face of the push-button 18 and at the other end on an outer face of the front end wall 17, as best seen in FIG. 3. A support member 23 is fixedly mounted on an inner face of the front end wall 17 of the casing 11 and extends substantially in parallel to the pressing rod 21. A latching lever 24 is pivotally mounted on the support member 23 through a pivotal pin 25 and is engageable at one end with the foremost end of the pressing rod 21. When the push-button 18 is mamually depressed against the opposing force of the preload spring 22 so that the pressing rod 21 projects deeper into the interior of the control section 13, the latching lever 24 is depressed by the pressing rod 21 and is caused to turn about the pivotal pin 25 counterclockwise of FIG. 3.

The latch mechanism further comprises a support structure 26 which is fixedly mounted on the inner face of the front end wall 17 of the casing 11 and which has a pair of spaced parallel side walls 27 and 28 extending substantially perpendicularly from the inner face of the front end wall 17 of casing 11 as seen in FIGS. 3 and 4. The side walls 27 and 28 of the support structure 26 are located on both sides of the elongated slot 16 so that the latch member 15 moves between the side walls 27 and 28 when the door structure 14 is moved toward or away from the position to close the cooking chamber 12. As will be seen in in FIG. 4, the support structure 26 is located substantially below the latching lever 24. Between the side walls 27 and 28 of the support structure 26 is positioned a rotary catch member 29 which is rotatably mounted on the side walls 27 and 28 through a shaft 30, as seen in FIGS. 4 and 5. As will be best seen in FIG. 6, the rotary catch member 29 is formed with a catch portion 31 configured to be closely engageable with the latch member 15 when the latch member is moved in between the side walls 27 and 28 of the support structure 26, a lever portion 32 located adjacent to the catch portion 31 and engageable with the leading end portion of the latch member 15 when the latch member 15 is being moved toward or away from a position to engage the catch portion 31, a spring retaining projection 33 extending in approximately diametrically opposed relation to the lever portion 32, and a radial projection 34 which is located opposite to the catch portion 31 across the lever portion 32. When the rotary catch member 29 thus configured is held in an angular position having the catch portion 31 engaged by the latch member 15, the lever portion 32 is inclined upwardly, the spring retaining projection 33 inclined downwardly, and the radial projection directed approximately horizontally, as indicated by full and dotted lines in FIG. 5. When, conversely, the rotary catch member 29 is in an angular position having the catch portion 31 disengaged from the latch member 15, the lever portion 32 is directed substantially upright, the spring retaining projection 33 directed straight downward, and the radial projection 34 held in a raised position and directed appreciably upward, as indicated by phantom lines in FIG. 5. Underneath the rotary catch member 29 is positioned a reversing spring 35 which is in the form of a cylindrical coil spring as seen in FIG. 5. The reversing spring 35 is retained at one end by the spring retaining projection 33 of the rotary catch member 29 and at the other end by a spring retaining member 36 which is fixedly mounted on a bottom wall (not shown) of the casing 11 defining the control section 13. The rotary catch member 29 is thus biased by means of the reversing spring away from a neutral position toward either of the positions to have its catch portion 31 engageable or not engageable with the latch member 15, viz., the positions which are indicated by full and phantom lines in FIG. 5.

On an outer face of the side member 28 of the support structure 26 is pivotally mounted a control lever 37 through a pivotal pin 38. The control lever 37 has an upper arm portion 39 terminating above the previously mentioned rocking lever 24 and a lower arm portion 40 terminating below the rotary catch member 29. The control lever 37 is thus engageable at its upper arm portion 39 with the end portion of the rocking lever 24 opposite to the end of the lever 24 engaged by the pressing rod 21, as best seen in FIG. 4. The lower arm portion 40 of the control lever 37 is formed with substantially vertically elongated slots 41 and 42. The rotary catch member 29 is formed with a pin 43 extending in parallel to the pivotal shaft 30 from one side face of the catch member 29. The pin 43 projects into the elongated slot 41 so that the control lever 37 is rotated about the pivotal pin 38 when the rotary catch member 29 is rotated about an axis of the pivotal pin 30. The pin 43 is shown as being located adjacent to the spring retaining projection 33 of the catch member 29, viz., substantially diametrically opposed relation to the lever portion 32 of the catch member 29. Such is, however, merely by way of example, and, thus, the pin 43 may be otherwise located on the side face of the catch member 29 insofar as the rotational motion of the catch member 29 about the axis of the pivotal pin 30 can be translated into a rotary motion of the control lever 37 about an axis of the pivotal pin 38. For the reason to be explained later, the elongated slot 41 to receive the pin 43 is formed to have a width larger than a diameter of the pin 43 so as to provide a certain amount of clearance between the pin 43 and a vertical edge of the control lever 37 defining the slot 41. As seen in FIG. 5, the control lever 37 is in engagement at a leading end of its upper arm portion 39 with an actuating member 44 of electric switch means (not shown) of the microwave oven through a lever linkage 45 while the door 14 is closed.

The latch mechanism further comprises a hook member 46 which is pivotally mounted on the side walls 27 and 28 of the support structure 26 through a pivotal pin 47 extending parallel to the shaft 30 of the catch member 29. The hook member 46 has a hook portion 48 which is engageable with the radial projection 34 of the catch member 29 and a pin 49 projecting from a side wall of the hook member 46 in parallel to the pivotal pin 47. The pin 49 thus formed on the hook member 46 is received in the elongated slot 42 in the lower arm portion 40 of the control lever 37 so that the hook member 46 is rotated about an axis of the pivotal pin 47 when the control lever 37 is rotated about an axis of the pivotal pin 38. The hook member 46 is thus rotatable about the axis of the pivotal pin 47 between a position to have its hook portion 48 engageable with the radial projection 34 of the rotary catch member 29 as indicated by full lines in FIG. 5 and a position to have the hook porton 48 angularly spaced apart from the catch member 29 as indicated by phantom lines in FIG. 5. The hook member 46 is biased to move toward the latter position by means of a preloaded tension spring 50 which connected at one end to the bottom portion of the hook member 46 and at the other end to the front end wall 17 of the casing 11 through a spring retaining member 51 as seen in FIG. 5.

When the door structure 14 is in a position to open the cooking chamber 12 of the microwave oven, the reversing spring 35 is held in a condition to maintain the rotary catch member 29 in a postion to have its lever portion 32 directed straight upward as indicated by the phantom lines in FIG. 5 and, at the same time, the tension spring 50 is operative to urge the hook member 46 into the angular position having its hook portion 48 spaced apart from the rotary catch member 29 as also indicated by the phantom lines in FIG. 5. When, now, the door structure 14 is moved toward the position to close the cooking chamber 12 of the microwave oven, the latch member 15 carried on the inner face of the door structure 14 is admitted into the slot 16 in the casing 11 of the oven and abut against the lever portion 32 of the rotary catch member 29. The lever portion 32 of the catch member 29 is consequently pressed away from the the front end wall 17 of the casing 11 by the latch member 15 so that the catch member 29 is caused to rotate clockwise of the drawings (FIGS. 4, 5 and 6) about the axis of the shaft 30 into the position indicated by the full lines in FIG. 5 first against the force of the reversing spring 55 and then by the force of the reversing spring 35. When the rotary catch member 29 is moved to this position, the catch portion 31 thereof is engaged by the latch member 15 and is forced against the latch member 15 by the reversing spring 35. While rotary catch member 29 is thus being rotated into the position having its catch portion 31 engaged by the latch member 15, the pin 43 on the side face of the catch member 29 is also rotated clockwise of the drawings about the axis of the shaft 30 and causes the control lever 37 to rotate clockwise of the drawings (FIGS. 4 and 5) about the axis of the pivotal pin 38 into a position which is indicated by full lines in FIG. 5. Such a rotational motion of the control lever is transmitted to the switch actuating member 44 through the lever linkage 45 and to the hook member 46 through the pin 49 projecting from the side wall of the hook member 46 into the elongated slot 42 in the control lever 37. The hook member 46 is consequently rotated counterclockwise of the drawings (FIGS. 4, 5 and 6) about the pivotal pin 47 against the opposing force of the tension spring 50 until the hook portion 48 of the hook member 46 is brought into engagement with the radial projection 34 of the catch member 29, as indicated by full lines in FIG. 5. At the same time as the rotary catch member 29 is locked by the hook member 46 in this manner, the switch actuating member 44 is moved into a position to switch in the microwave oven. The rotational motion of the control lever 37 is also transmitted to the latching lever 24, which is consequently rotated about the pivotal pin 25 into engagement with the leading end of the pressing rod 21 which is connected to the push-button 18. Under the conditions in which the rotary catch member 29 has its catch portion 31 engaged by the latch member 15 and its radial projection 34 engaged by the hook portion 48 of the locking member 46, the pin 43 projecting from the side face of the catch member 29 into the elongated slot 41 in the control lever 37 is located in such a manner to provide a certain amount of clearance between the pin 43 and the vertical edge of the slot 41 to be engaged by the pin 43 when the catch member 29 is rotated in a reverse direction.

When, then, the push-button 18 is depressed, the pressing rod 21 connected to the push-button is axially moved deeper through the aperture 20 in the front end wall 17 of the casing 11 and presses the end portion of the latching lever 24 which has been moved to the position engaging the pressing rod 21 as previously mentioned. The latching lever 24 is therefore rotated counterclockwise of the drawing (FIG. 3) about the pivotal pin 25 and, in turn, caused the control lever 37 to rotate counterclockwise of the drawings (FIGS. 4 and 5) about the pivotal pin 38. For a certain period of time after the control lever 37 is thus rotated counterclockwise of the drawings by means of the latching lever 24, the pin 43 on the rotary catch member 29 remains disengaged from the control lever 37 by reason of the clearance provided between the pin 43 and the vertical edge defining the elongated slot 41 and, thus, the rotary catch member 29 is maintained in situ irrespective of the rotational motion of the control lever 37. While the control lever 37 is thus being rotated an angle which corresponds to the clearance between the pin 43 and the vertical edge of the slot 41, the rotational motion of the control lever 37 is transmitted to the switch actuating member 44 through the lever linkage 45 and to the hook member 46 through the pin 49 thereon. The switch actuating member 44 is consequently moved into a position switch off the microwave oven and at the same time the hook member 46 is caused to rotate clockwise of the drawings (FIGS. 4, 5 and 6) about the pivotal pin 47 so that the hook portion 48 of the hook member 46 is disengaged from the radial projection 34 of the catch member 29. Once the hook portion 48 of the hook member 46 is thus disengaged from the radial projection 34 of the catch member 29, the hook member 46 is moved by the force of the tension spring 50 into the position spaced apart from the catch member 29 as indicated by the phantom lines in FIG. 5. When the control lever 37 is further rotated counterclockwise of the drawings about the pivotal pin 38, and accordingly the pin 43 on the rotary catch member 29 is brought into abutting engagement with the vertical edge of the elongated slot 41 in the control lever 37, the rotational motion of the control lever 37 is transmitted through the pin 43 to the catch member 29, which is consequently caused to rotate counterclockwise of the drawings (FIGS. 4 and 5) about the axis of the shaft 30 against the force of the reversing spring 35 and is disengaged from the latch member 15. The reversing spring 35 is now moved to the position urging the catch member 29 toward the angular position to be engageable with the latch member 15 and, thus, the catch member 29 is rapidly rotated counterclockwise of the drawings by the action of the reversing spring 35. The last member 15 is consequently struck by the lever portion 32 of the catch member 29 and is thereby pressed outwardly of the interior of the control section 13, moving the door structure 14 into a position to open the cooking chamber 12. The door structure 14 is in this manner opened simply by depressing the push-button 18.

Figure 7:
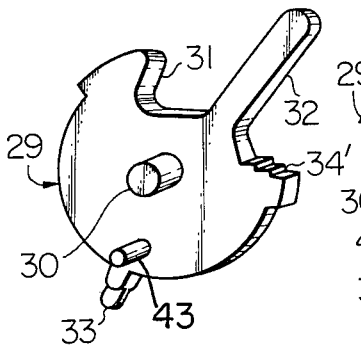
FIG. 7 is a perspective view which shows a modified form of catch means which may be incorporated into the embodiment of the latch mechanism illustrated in FIGS. 3, 4 and 5.
Figure 6:
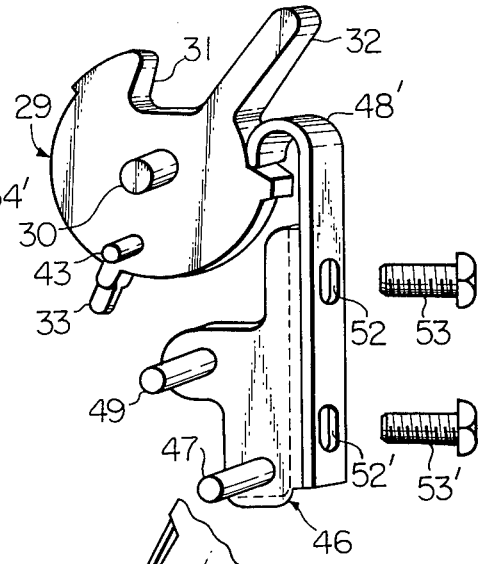
FIG. 6 is a perspective view which shows preferred configurations of the catch means and the latching means incorporated into the embodiment shown in FIGS. 3, 4 and 5.

The hook portion 48 of the hook member 46 has been assumed to be formed as an integral part of the hook member 46. To assure, however, close fit between the hook portion 48 and the radial projection 34 of the rotary catch member 29, it will be advantageous if the relative position of the hook portion 48 to the body of the hook member 46 and thereby to the radial projection 34 of the catch member 29. For this purpose, the hook portion 48 may be formed separately of the body of the hook member 46 and connected to the hook member by suitable adjustable fastening means, an example of such an arrangement being illustrated in FIG. 6. In FIG. 6, the hook portion, now designated by reference numeral 48′, is formed as a separate member elongated slots 52 and 52′ and is fastened to the hook member 46 by means of screws 53 and 53′ so that the relative position of the hook portion 48′ is adjustable through adjustment of the relative positions of the screws 53 and 53′ to the elongated slots 52 and 52′. While, moreover, the radial projection 34 of the rotary catch member 29 has been assumed to engage the hook portion 48 or the above mentioned hook portion 48′ at its substantially flat surface which is usually downwardly inclined toward the end of the projection, the radial projection may be outwardly downwardly stepped as indicated at 34′ in FIG. 7 so that the hook portion 48 or 48′ may engage any of the stepped faces of the radial projection 34′. This will also contribute to assuring close fit between the radial projection of the catch member 29 and the hook portion 48 or 48′.

Figure 8:
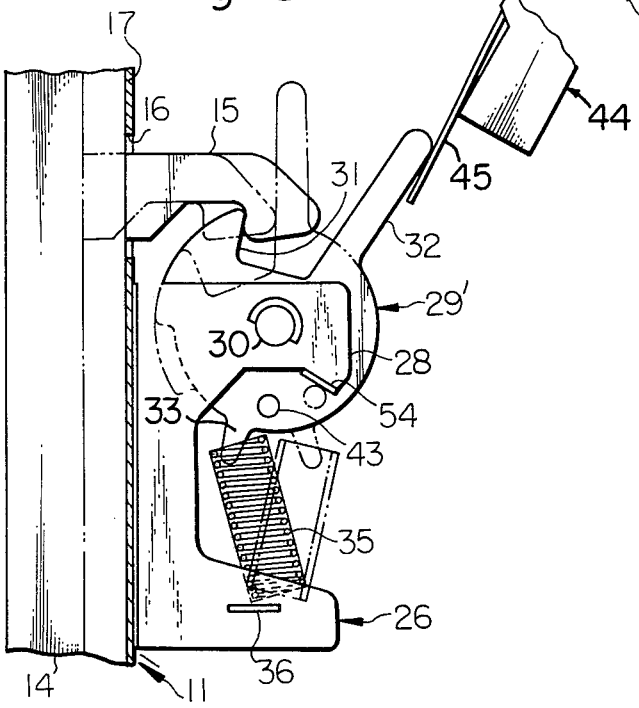
FIG. 8 is a side elevational view of a second preferred embodiment of the latch mechanism according to the present invention.

FIG. 8 illustrates another preferred embodiment of the door latch mechanism according to the present invention. The latch member herein shown is essentially similar in effect to the embodiment thus far described but differs therefrom mainly in that the rotational motion of the rotary catch member is transmitted directly to the lever linkage connected to the actuating member of the switch means of the microwave oven and that the latching arrangement of the nature incorporated into the previously described embodiment is dispensed with. The latch mechanism herein shown is thus void of the control lever 37, the hook member 46 and the part which are associated with these members and, accordingly, the rotary catch member, now designated by reference numeral 29′ is void of the radial projection 34 to engage the hook member 46 in the previously described embodiment. In the embodiment shown in FIG, 8, the side wall 28 of the support structure 26 is formed with an abutment portion 54 which is located in the path of the pin 43 formed on the side face of rotary catch member 29′. When the rotary catch member 29′ is rotated about the axis of the shaft 30, the pin 43 on the catch member 29′ will strike the abutment portion 54 of the side wall 28 of the support member 26 and cause the catch member 29′ to stop rotation. The pin 43 and the abutment portion 54 are thus located to stop the rotary catch member 29′ when the catch member 29′ is rotated to an angular position disengaged from the latch member 15 as indicated by phantom lines in FIG. 8. The pin 43 is thus utilized for the purpose of limiting the rotational motion of the rotary catch member 29′ in the embodiment of FIG. 8. The lever portion 32 of the rotary catch member 29′ is engageable at its leading end with the switch actuating member 44 through the lever linkage 45 so that the rotational motion of the catch member 29′ is directly transmitted to the lever linkage 45 through the lever portion 32 of the catch member 29′.

When, now, the door structure 14 is in an open condition, the latch member 15 thereon is withdrawn from the slot 16 in the front end wall 17 of the casing 11 and at the same time the rotary catch member 29′ is held by the action of the reversing spring 35 and by the engagement between the pin 43 and the abutment portion 54 of the support structure 26 in an angular position having its lever portion 32 in a substantially upright condition which is close to the front end wall 17 of the casing 11. When the door structure 14 is closed from these conditions, the latch member 15 on the door structure 14 is moved through the slot 16 in the front end wall 17 of the casing 11 and abuts against the lever portion 32 of the rotary catch member 29′. The rotary catch member 29′ is consequently rotated about the axis of the shaft 30 and, by the reversed action of the reversing spring 35, urged to an angular position having the catch portion 31 of the catch member 29′ in engagement with the latch member 15. As the rotary catch member 29′ is rotated to this angular position, the lever portion 32 of the catch member 29′ drives the switch actuating member 44 through the lever linkage 45 so that the microwave oven is switched on by the switch means actuated by the switch actuating member 44. The latch condition of the door structure 14 thus established is maintained by the action of the reversing spring 35 which is operative to force the catch portion 31 of the rotary catch member 29′ against the latch member 15 as indicated by full lines in FIG. 8. To unlatch the door structure 14, the door structure may be manually opened so that the latch member 15 pulls the catch portion 31 of the catch member 29′ toward the front end wall 17 of the casing and consequently the catch member 29′ is rotated counterclockwise of the drawing against the action of the reversing spring 35. When the rotary catch member 29′ passes through a neutral angular position, the action of the reversing spring 35 is reversed so that the catch member 29′ is rotated by the action of the spring 35 toward the angular position having its catch portion 31 completely disengaged from the latch member 15. The rotational movement of the catch member 29′ thus caused by the reversing spring 35 is stopped when the pin 43 on the catch member 29′ is brought into abutting engagement with the abutment portion 54 of the side wall 28 of the support structure 26. The latch mechanism shown in FIG. 8 is thus adapted to be unlatched responsive to the opening movement of the door structure 14. It will be, however, apparent that such a mechanism may be modified so as to be unlatched by a push-botton arrangement through provision of the previously described push-botton 18, latching lever 24, and the control lever 37 incorporated into the embodiment shown in FIGS. 3, 4 and 5.

FIGS. 9*a*, 9*b* and 10 illustrate a third preferred embodiment of the door latch mechanism according to the present invention. Referring concurrently to FIGS. 9*a*, 9*b* and 10, the latch member 15 on the inner face of the door structure 14 is engageable with a catch member 55 which is, in this instance, in a generally rod form. The catch member 55 is positioned substantially perpendicularly to the patch of the latch member 15 and is axially slidably received on spaced parallel support members 56 and 56′. The catch member 55 is thus movable toward and away from a position to be engageable with the latch member 15 and is biased to move toward such a position by means of preloaded spring 57 which is seated at one end on the support member 56 and at the other end on spring retaining pins 58 formed or mounted on the catch member 55. The catch member 55 has formed in its rear end portion a lateral groove 59 which has flaring ends for the reason to be described later.

Designated by reference numeral 60 is a switch housing which is fixedly mounted on the casing 11 and which has accommodated therein switch means (not shown) of the microwave oven. The switch housing 60 has a support member 61 on which a bell-crank lever 62 is pivotally mounted through a pivotal pin 63. The bell-crank lever 62 has a first arm portion 64 extending substantially in parallel to the front end wall 17 of the casing 11 and engageable at its leading end portion with the foremost end of the pressing rod 21 connected to the push-button 18 and a second arm portion 65 extending substantially at right angles from the first arm portion 64 and loosely received in the lateral groove 59 in the catch member 55. The second arm portion 65 of the bell-crank lever 62 has an intermediate recessed portion as indicated at 65*a* for the reason to be understood later. The pressing rod 21 is connected to the push-button 18 which is mounted on the outer face of the front end wall 17 of the casing 11 as previously mentioned in connection with the embodiment previously described with reference to FIGS. 3, 4 and 5. Different from the push-button 18 and the pressing rod 21 of the previously described embodiment, the push-button 18 and the pressing rod 21 are provided with no spring arrangement which is operative to urge the push-button away from the front end wall 17 of the casing 11.

On the support member 61 of the switch housing 60 is further mounted a control lever 66 through a pivotal pin 67. The control lever 66 has a first arm portion 68 which is engageable at its leading end portion with the foremost end of the latch member 15 and a second arm portion 69 which is connected at its leading end portion with the support member 61 through a tension spring 70. The tension spring 70 is operative to urge the control lever 66 to turn counterclockwise of the drawing about an axis of the pivotal pin 67 and, the latch member 15 happens to be in a condition projecting into the interior of the casing 11 as shown, the control lever 66 is forced by the tension spring 70 to press the latch member 15 toward its retracted position. The second arm portion 69 of the control lever 66 overrides the sunk intermediate portion 65*a* of the second arm portion 65 of the bell-crank lever 62 as will be better seen in FIG. 9 and is formed with an abutment portion 71 which is engagable with the recessed intermediate portion 65*a* of the bell-crank lever 62 when the control lever 66 is rotated by the action of the tension spring 70 into an angular position in which the first arm portion 68 of the control lever 66 is located closest to the front end wall 17 of the casing 11. From the switch housing 60 extends a switch actuating lever 72 which is pivotally connected at its foremost end to the catch member 55 through a pivotal pin 73.

When the door structure 14 is in an open condition, the latch member 15 is held in a position withdrawn from the slot 16 in the front end wall 17 of the casing 11. The control lever 66 is consequently maintained by the action of the tension spring 70 in an angular position so that its first arm portion 68 is located closest to the front end wall 17 of the casing 11. Under these conditions, the abutment portion 71 of the control lever 66 is captured in the U-shaped intermediate portion 65*a* of the bell-crank lever 62 so that the bell-crank lever 62 is forcibly held in a position to maintain the catch member 55 in its retracted position which is remote from the position engageable with the latch member (FIG. 9*b*). When the door structure 14 is then closed, the latch member 15 on the door structure 14 projects into the interior of the casing 11 through the slot 16 in the front end wall 17 of the casing and is brought into pressing engagement with the first arm portion 68 of the control lever 66 in the absence of the catch member 55 in the path of the latch member 15. The control lever 66 is consequently rotated clockwise of the drawing, viz., in a direction to have its first arm portion 68 moved away from the front end wall 17 of the casing 11 against the opposing force of the tension spring 70. The abutment portion 71 of the control lever 66 is thus disengaged from the recessed intermediate portion 65*a* of the bell-crank lever 62 so that the catch member 55 is allowed to axially move forward by the force of the preloaded spring 57. When the catch member 55 is axially moved forward, the switch actuating lever 72 is driven by the catch member 55 through the pivotal pin 73 and actuates the switch means in the switch housing 60 whereby the microwave oven is switched on. The catch member 55 is thereafter further moved forward by the preloaded spring 57 and is brought into engagement with the latch member 15. The door structure 14 is latched to the casing 11 after the over has been switched on. When the push-button 18 is manually depressed from these conditions, the pressing rod 21 presses the first arm portion 64 of the bell-crank lever 62, which is consequently rotated counterclockwise of the drawing about an axis of the pivotal pin 63. The second arm portion 65 is therefore turned about the axis of the pivotal pin 63 in a direction to move the catch member 55 from the position engaging the latch member 15 toward a retracted position to be disengaged from the latch member 15 against the opposing force of the preloaded spring 57. The switch actuating member 72 is thus driven by the catch member 55 and causes the switch means in the switch housing 60 to open. When the catch member 55 is completely released from the latch member 15, the control lever 66 is forced by the tension spring 70 to rotate counterclockwise of the drawing, viz., in a direction to have its first arm portion 68 moved closer to the front end wall 17 of the casing 11 with the result that the latch member 15 is caused to withdraw from the interior of the casing 11, causing the door structure 14 to open. When the control lever 66 is rotated to the angular position in which the first arm portion 68 thereof is located closest to the front end wall 17 of the casing 11, the abutment portion 71 of the control lever 66 is captured in the recessed intermediate portion 65*a* of the second arm portion 65 of the bell-crank lever 62. The bell-crank lever 62 is thus held in a position to maintain the catch member 55 in the retracted position even when the push-button 18 is released and accordingly the bell-crank lever 62 is disengaged from the pressing rod 21.

From the foregoing description it will now be understood that the door latch mechanism according to the present invention provides the following advantages:

1. The door structure can be securely held closed once the latch mechanism is brought into the latching condition. Where the latch mechanism is incorporated into the microwave oven, therefore, leakage of the microwaves from the cooking chamber of the oven can be completely prevented.

2. Where the latch mechanism is used in combination with a door of electrical equipment having switch means such as the microwave oven, the switch means is opened before the door is opened so that the door can be opened only after the electrical equipment has been de-energized or, in the case of the microwave oven, after the microwaves have disappeared in the cooking chamber. Since, moreover, the switch means is actuated by means of a leverage linkage, the closing or opening movement of the door structure is amplified when transmitted to the switch means. The switch means is thus responsive to an extremely small amount of displacement of the door structure, assuring reliability of operation of the switch means.

3. No manipulative members and springs are mounted on the door structure.

4. Where the latch mechanism is arranged to be unlatched by means of the push-button as in the first and third embodiments, the door can be opened simply by manually depressing the push-botton.

5. The catch arrangement incorporated into the latch mechanism can be assembled as a standardized unit, providing compact construction of the latch mechanism as a whole.

What is claimed is:

1. A latch mechanism for latching a door structure to a casing, comprising in combination a latch member movable with the door structure, a support member fixedly mounted on the casing, catch means supported on the support member and having a first position engageable with the latch member for latching the door structure to the casing and a second position engageable with the latch member for maintaining the door structure unlatched from the casing, resilient biasing means responsive to movement of the catch means between the first and second positions thereof and operative to bias the catch means toward the first position when the catch means is moved toward and into the first position thereof and to bias the catch means toward the second position when the catch means is moved toward and into the second position, electric switch means having a closed condition responsive to the movement of the catch means into the first position thereof and an open condition responsive to the movement of the catch means toward the second position thereof, leverage linkage means which is engageable at one end with said catch means and at the other end with said electric switch means for amplifying and transmitting the movement of the catch means to the first or second position thereof to the switch means, and manually-operated unlatching means responsive to the first position thereof and movable between a first position to allow the catch means to stay in the first position thereof and a second position to hold the catch means out of the first position thereof, said unlatching means being held in the first position thereof when the catch means is in the first position thereof and being moved to the second position thereof when manually operated, said leverage linkage means being engageable at said one end with the unlatching means for transmitting the movement of the unlatching means toward the second position thereof to the switch means and thereby actuating the switch means into said open condition when the unlatching means is manually moved into the second position thereof.

2. A latch mechanism as set forth in claim 1, further comprising hook means engaging said catch means and said unlatching means through said leverage linkage and movable between a first position to be in latching engagement with the catch means responsive to the movement of the catch means to the first position thereof and a second position disengaged from the catch means responsive to the movement of the unlatching means to the second position thereof.

3. Latch mechanism as set forth in claim 1, further comprising means for delaying movement of said catch means from said first position to said second position upon movement of said unlatching means from said first position to said second position, whereby said switch means is actuated into said open condition before said catch means is moved to said second position.

4. Latch mechanism as set forth in claim 3, wherein said delaying means comprises means providing clearance between said catch means and said unlatching means.

5. A latch mechanism as set forth in claim 2, in which said catch means comprises a rotary catch member rotatably mounted on said support member and formed with a catch portion which is engageable with said latch member when the latch member is in said first position thereof and a lever portion merging from the catch portion and engageable with the latch member when the latch member is in the vicinity of said first position thereof and simultaneously the catch means is in the first position thereof so that the latch member is in pressing engagement with the lever position when being moved toward the first position thereof and is forced away from the first position by the lever portion when the catch means is being moved toward the second position thereof.

6. A latch mechanism as set forth in claim 5, in which said catch means further comprises a projection engageable with said hook means.

7. A latch mechanism as set forth in claim 6, in which said projection has a stepped wall through which the projection is engageable with the latching means.

8. A latch mechanism as set forth in claim 5, in which said hook means comprises a hook member rotatably mounted on said support member and having a hook portion engageable with said catch member.

9. A latch mechanism as set forth in claim 8, in which said hook portion is formed separately of the hook member and fixedly mounted thereon through adjustable fastening means, so that the relative position of the hook portion to the catch member is adjustable.

10. A latch mechanism as set forth in claim 5, in which said resilient biasing means comprises a reversing spring which is connected at one end to said support member and at the other to said catch member for biasing the catch member away from a neutral position between said first and second positions of the catch means.

11. A latch mechanism for latching a door structure to a casing, comprising in combination a latch member movable with the door structure, a support member fixedly mounted on the casing, catch means supported on the support member and having a first position engageable with the latch member for latching the door structure to the casing and a second position unengageable with the latch member for maintaining the door structure unlatched from the casing, resilient biasing means responsive to movement of the catch means between the first and second positions thereof and operative to bias the catch means toward the first position when the catch means is moved toward and into the first position thereof and to bias the catch means toward the second position when the catch means is moved toward and into second position, manually-operated unlatching means movable between a first position to allow the catch means to stay in the first position thereof and a second position to hold the catch means out of the first position thereof, electric switch means having a closed condition responsive to the movement of the catch means into the first position thereof and an open condition responsive to the movement of the catch means toward the second position thereof, a first leverage linkage means which is engageable at one end with said manually-operated unlatching means and at the other end with said catch means for transmitting the movement of said manually-operated unlatching means toward the second position thereto to the latch means for moving the catch means to the second position thereof when said manually-operated unlatching means is manually moved to the second position thereof, a second leverage linkage means which is engageable with said latch member and biased by said resilient biasing means toward a position to urge said latch member out of the first position thereof, and a third leverage linkage means engaging at one end with the catch means and at the other end with said switch means for transmitting and amplifying the movement of the catch means of the first or second position thereof.

12. A latch mechanism as set forth in claim 11 wherein said second leverage linkage means includes an abutment portion which abutts against said first leverage linkage means for forcibly holding the catch means in the second position thereof when the latch member is withdrawn from the first position thereof.

13. A latch mechanism as set forth in claim 12, wherein said resilient biasing means comprises a first spring biasing said catch means toward the first position thereof and a second spring biasing said second leverage linkage toward a position to urge the latch member out of the first position thereof and to bring said abutment portion into abutting against said first leverage linkage.

14. A latch mechanism as set forth in claim 11 wherein said catch means comprises an elongated catch member axially movable on said support member between the first and second positions of the catch means, and being formed with a lateral recess in which said first leverage linkage means is loosely received at said other end.

* * * * *